US010480135B2

(12) United States Patent
Christian et al.

(10) Patent No.: US 10,480,135 B2
(45) Date of Patent: Nov. 19, 2019

(54) COLD IN-PLACE RECYCLING WITH HEATING ASSEMBLY INCLUDING A HEATER FOR ASPHALT CEMENT AND A HEAT-MODIFYING COMPONENT

(71) Applicant: Roadtec, Inc., Chattanooga, TN (US)

(72) Inventors: Richard Christian, Chattanooga, TN (US); Raymond Clark Baker, IV, Chattanooga, TN (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 16/259,599

(22) Filed: Jan. 28, 2019

(65) Prior Publication Data

US 2019/0153681 A1 May 23, 2019

Related U.S. Application Data

(63) Continuation-in-part of application No. 15/855,403, filed on Dec. 27, 2017, now Pat. No. 10,246,836.

(Continued)

(51) Int. Cl.
*E01C 23/00* (2006.01)
*E01C 23/06* (2006.01)

(Continued)

(52) U.S. Cl.
CPC ..... *E01C 23/065* (2013.01); *E01C 11/005* (2013.01); *E01C 23/127* (2013.01); *E01C 19/08* (2013.01)

(58) Field of Classification Search
CPC .... E01C 11/005; E01C 19/005; E01C 23/065; E01C 23/127

(Continued)

(56) References Cited

U.S. PATENT DOCUMENTS 3,100,425 A * 8/1963 Cartwright ..... E01C 19/174 239/100
3,833,310 A * 9/1974 Childree ..... E01C 19/10 404/75

(Continued)

FOREIGN PATENT DOCUMENTS

WO WO 2018/128888 A1 7/2018

OTHER PUBLICATIONS

European Search Report of counterpart European Application No. 19155761.0 dated Apr. 3, 2019.

*Primary Examiner* — Raymond W Addie
(74) *Attorney, Agent, or Firm* — Chambliss, Bahner & Stophel, P.C.

(57) ABSTRACT

A CIR train includes a milling machine, an asphalt cement supply tank, a mechanism for dispensing asphalt cement onto paving material that has been removed from the roadway by the milling machine, an asphalt cement pump for pumping asphalt cement from the asphalt cement supply tank into and through an asphalt cement flow circuit to the asphalt cement dispensing mechanism. A heating assembly is interposed in the asphalt cement flow circuit between the asphalt cement supply tank and the dispensing mechanism. The heating assembly includes a heater and a heat modifying component. The heater includes an asphalt cement coil that is in the asphalt cement flow circuit, and a burner that is adapted to direct hot gases of combustion across the asphalt cement coil. The heat modifying component is adapted to modulate the amount of heat transfer from the hot gases of combustion to the asphalt cement in the coil.

11 Claims, 12 Drawing Sheets

Related U.S. Application Data

(60) Provisional application No. 62/441,631, filed on Jan. 3, 2017, provisional application No. 62/629,296, filed on Feb. 12, 2018.

(51) Int. Cl.
*E01C 11/00* (2006.01)
*E01C 23/12* (2006.01)
*E01C 19/08* (2006.01)

(58) Field of Classification Search
USPC ..... 404/17, 28, 31, 34–36, 44; 14/73
See application file for complete search history.

(56) References Cited

U.S. PATENT DOCUMENTS 5,000,615 A * 3/1991 Murray ..... E01C 23/065 404/101
5,006,012 A * 4/1991 Sterner ..... E01C 19/21 404/107
5,219,450 A 6/1993 Thurk
5,741,085 A * 4/1998 Wirtgen ..... E01C 23/065 404/75
6,776,557 B2 * 8/2004 Barnat ..... E01C 19/21 404/101
8,403,595 B2 * 3/2013 Hall ..... E01C 23/088 299/39.1
10,005,622 B1 * 6/2018 Narsingh ..... B65G 47/18
2001/0022919 A1 * 9/2001 Bruns ..... E01C 19/176 404/91
2008/0260461 A1 * 10/2008 Berning ..... E01C 23/088 404/112
2009/0052987 A1 * 2/2009 Hall ..... B28D 1/186 404/90
2011/0091276 A1 * 4/2011 Hall ..... E01C 23/065 404/77
2012/0027514 A1 * 2/2012 Hall ..... E01C 23/065 404/91

* cited by examiner

COLD IN-PLACE RECYCLING WITH HEATING ASSEMBLY INCLUDING A HEATER FOR ASPHALT CEMENT AND A HEAT-MODIFYING COMPONENT

CROSS-REFERENCE TO RELATED APPLICATIONS

This application is a continuation-in-part of U.S. patent application Ser. No. 15/855,403 which was filed on Dec. 27, 2017 and claims the benefit of U.S. Provisional Patent Application No. 62/441,631 that was filed on Jan. 3, 2017. This application also claims the benefit of U.S. Provisional Patent Application No. 62/629,296 which was filed on Feb. 12, 2018.

FIELD OF THE INVENTION

The present invention relates generally to repair and repaving of roadways with asphalt paving material. More particularly, the invention relates to equipment for use in cold in-place repaving of roadways with recycled asphalt material.

BACKGROUND OF THE INVENTION

Roadway repair is often accomplished by overlaying the existing pavement (whether of concrete or asphalt paving material) with a new layer (often called a leveling course) of concrete or asphalt paving material. Without prior surface treatment, however, this method of repair generally results in the application of insufficient quantities of paving material in the rutted, potholed or otherwise damaged areas, because the overlay will be applied at the same rate per unit of roadway width in damaged areas (which have a greater depth to be filled across the width) as in the undamaged areas. The resulting reduced thickness in the overlay of the previously damaged areas will lead to renewed rutting or other wear damage in the new pavement in relatively short order. However, by milling the surface of the damaged pavement to a uniform surface elevation below the level of the damage, the addition of new pavement will produce a road surface having a consistent elevation across the entire width of the roadway. This repaving technique can be used to return the elevation of a damaged roadway to its original pre-damaged elevation, whereas the placement of a leveling course atop damaged but un-milled pavement will tend to raise the surface of the roadway or some portion thereof above its original elevation. Roadway repair without milling can require the raising of road shoulders, guardrails and manhole covers and the adjustment of overpass clearances, which tasks are unnecessary if a proper milling technique is employed. A use of milling prior to repaving can also permit ready establishment of the proper road grade and slope, and thereby avoid drainage and safety problems. Furthermore, milling typically provides a rough surface that readily accepts and bonds with the new asphalt or other pavement overlay. Finally, milling can provide raw material that can be reclaimed for use in the production of new paving materials.

A milling machine includes a milling drum with a plurality of cutter teeth mounted thereon which is contained within a milling drum housing. The milling machine is adapted to be advanced across a roadway surface while the milling drum is rotated within the housing to "mill" the surface to remove asphaltic or Portland cement concrete pavement in preparation for recycling the pavement and/or in preparation for applying a pavement overlay. The typical milling machine includes one or more conveyors to take the milled paving material from the vicinity of the milling drum and direct it away from the machine and into an adjacent dump truck. A road stabilizer/reclaimer machine is similar to a milling machine in that it comprises a wheeled or track-driven vehicle that includes a milling drum with a plurality of cutter teeth mounted thereon which is contained within a milling drum housing. However, the milling drum of a road stabilizer/reclaimer machine is generally employed to mill or pulverized an existing road bed or roadway to a greater depth than does a milling machine prior to repaving (usually called reclaiming) or prior to initial paving (usually called stabilizing), and it leaves the pulverized material in place.

Cold in-place recycling ("CIR") equipment can be used to repair damage to a roadway in a single pass, while reusing essentially all of the existing milled paving material. In the CIR process, a milling machine is employed to remove damaged layers of pavement, and the removed paving material is processed, replaced on the roadway and compacted. If a roadway has good structural strength, CIR can be an effective treatment for all types of cracking, ruts and holes in pavement. CIR can be used to repair roadways damaged by fatigue (alligator) cracking, bleeding (of excess asphalt cement), block cracking, corrugation and shoving, joint reflective cracking, longitudinal cracking, patching, polished aggregate, potholes, raveling, rutting, slippage cracking, stripping and transverse (thermal) cracking. The root cause of the pavement failure should always be investigated to rule out base failure. However, CIR can almost always be used when there is no damage to the base of the roadway. Generally, CIR is only half as expensive as hot mix paving (i.e., paving with new asphalt paving material) while providing approximately 80% of the strength of hot mix paving.

CIR can be carried out with the aid of a milling machine or a road stabilizer/reclaimer machine that has been modified by mounting an additive spray bar in the milling drum housing to inject asphalt cement into the milling drum housing. The asphalt cement is then thoroughly blended with the milled material by the milling drum. This blended mixture may then be deposited on the roadway in the form of a windrow to be picked up by a suitably equipped asphalt paving machine, or it may be fed by the milling machine's discharge conveyor directly into the receiving hopper of an asphalt paving machine. When the CIR process is carried out with only a milling machine or stabilizer/reclaimer and an asphalt paving machine, the asphalt cement component of the mixture must be supplied from a separate asphalt cement supply tank carried by a supply truck, vehicle, wheeled chassis or other mobile support that is typically coupled to the modified milling machine or road stabilizer/reclaimer machine. The asphalt cement component is drawn directly from the tank on the supply truck and metered through an asphalt cement flow circuit to the spray bar in the milling drum housing.

Sometimes the CIR process is carried out with a milling machine or stabilizer/reclaimer in train with a cold recycler machine such as the RT-500 that is made and sold by Roadtec, Inc. of Chattanooga, Tenn. The cold recycler machine may include a vibratory screen, a crusher, an onboard source of asphalt cement and a pugmill mixer. When the CIR process is carried out using a cold recycler machine, the recycled paving material that is milled by the milling machine is transferred to the vibratory screen. Oversized material on the screen is conveyed into a crusher on the cold recycler machine, and material passing through the crusher is carried back to the screen by means of a return circuit. Properly sized material is then mixed with asphalt cement from an onboard storage tank in the pugmill mixer. Because the onboard asphalt cement storage tank in a cold recycler machine is limited in size, it may be desirable to convey additional asphalt cement from a separate supply truck to the asphalt cement storage tank on the cold recycler machine, in order to insure that the CIR process can proceed without frequent stops to refill the asphalt cement storage tank on the cold recycler machine. In either configuration of the CIR equipment, the primary component of the new pavement is paving material that is removed from the roadway. The only other component of the new pavement is the asphalt cement carried by the cold recycler machine and/or by a mobile supply vehicle. Since the rate of advance of the equipment engaged in the CIR process is determined primarily by the rate of advance of the milling machine, it is common for all of the components of the CIR process except for the asphalt paving machine to be coupled together so as to move at the same rate during all phases of the CIR process. Such components employed in carrying out a CIR process are frequently referred to as a CIR train.

Asphalt cement performs best in the CIR process when it is applied at a temperature within the range of about 300° to about 350° F. Although the asphalt cement supply truck is typically thermally insulated, it does not include any heating mechanism for maintaining the temperature of the asphalt cement as the CIR process is carried out. Consequently, the asphalt cement in the supply truck will begin to lose heat as soon as the truck leaves the asphalt cement supply terminal. If the CIR process is being carried out at a great distance from the asphalt cement supply terminal, the asphalt cement in the supply truck will have lost a significant part of its heat even before the CIR process is begun. Furthermore, the CIR process may begin at a time of day such that it cannot be completed during a single operating shift. When the temperature of the asphalt cement in the supply truck falls below about 300° F., for whatever reason, its continued use will likely result in a repaired roadway of substandard quality.

Co-pending U.S. patent application Ser. No. 15/855,403 describes a method and apparatus for heating asphalt cement that is carried in an asphalt cement supply tank prior to the use of such asphalt cement in a CIR process. The apparatus described in this application comprises a heater for asphalt cement that is a part of a CIR train. More particularly, the heater is interposed between the asphalt cement supply tank and the component of the CIR train that is dispensing asphalt cement to be mixed with recycled paving material in the CIR process. Preferably, a heater with an infinitely variable heating output between about 300,000 BTUs per hour and about 500,000-750,000 BTUs per hour is employed in the method of this co-pending patent application; however, infinitely variable heaters with heating outputs in this range are difficult to find. Consequently, it would be desirable if an apparatus could be provided that would allow for heating asphalt cement by the required amount using a much simpler heating apparatus.

Advantages of the Invention

Among the advantages of a preferred embodiment of the invention is that it provides a method and apparatus that allows the CIR process to continue without concern for the loss of heat in the asphalt cement carried by the supply truck. Yet another advantage of a preferred embodiment of the invention is that it provides an apparatus that employs a simpler heating apparatus than one providing an infinitely variable heating output between its maximum and minimum rated Btu values.

Other advantages and features of this invention will become apparent from an examination of the drawings and the ensuing description.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "attached", "coupled", "connected" and "interconnected", refer to a relationship wherein structures are secured or attached to one another either directly or indirectly through intervening structures, as well as both moveable and rigid attachments or relationships, unless otherwise specified herein or clearly indicated as having a different relationship by context. The terms "operatively connected" and "operatively attached" describe such an attachment, coupling or connection that allows the pertinent structures to operate as intended by virtue of that relationship. The term "fluid communication" refers to such an attachment, coupling or connection that allows for flow of fluid from one such structure or component to or by means of the other.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "asphalt cement" includes asphalt cement of various types and formulations in liquid form, as well as foamed asphalt cement and asphalt cement emulsions which are capable of fluid flow.

The term "milling machine" refers to a machine having a milling or working drum that is adapted to be placed into contact with a roadway or road base surface for removing a portion of the surface. The term "milling machine" includes but is not limited to machines that are sometimes referred to as road stabilizers and roadway reclaiming machines. The term "milling machine" also includes a CIR-modified milling machine, as hereinafter defined.

The term "CIR process" refers to a use of cold in-place recycling ("CIR") equipment to repair damage to a roadway, by removing damaged layers of pavement, processing the paving material so removed, replacing the removed and processed paving material onto the roadway, and compacting it.

The term "CIR-modified milling machine" refers to a milling machine which has been modified by the addition of an asphalt cement flow system including a spray assembly that is mounted in the milling drum housing to dispense asphalt cement into the milling drum housing.

The term "CIR train" refers to a plurality of items of equipment including, but not limited to, a mobile asphalt cement supply tank and a milling machine (which may or may not be a CIR-modified milling machine), which items of equipment are used, or intended to be used, in a CIR process. A CIR train may include a cold recycler machine, and it will also include an asphalt paving machine, although the asphalt paving machine may be employed at a time subsequent to the passage of the other components of the CIR train to pick up a windrow of processed paving material from the roadway.

The term "processing direction" refers to the primary direction of travel of a CIR train as it operates on a roadway.

The term "downstream", as used herein to describe a relative position on or in connection with an asphalt cement flow circuit that is a part of, or that relates to, the invention, refers to a relative position in the direction of the flow of asphalt cement from the supply tank to the component of a CIR train that is dispensing asphalt cement to be mixed with recycled paving material in a CIR process according to the invention.

The term "upstream", as used herein to describe a relative position on or in connection with an asphalt cement flow circuit that is a part of, or that relates to, the invention, refers to a relative position in a direction that is opposite to the direction of the flow of asphalt cement from the supply tank to the component of a CIR train that is dispensing asphalt cement to be mixed with recycled paving material in a CIR process according to the invention.

SUMMARY OF THE INVENTION

The invention comprises a method and apparatus for heating asphalt cement that is discharged from a mobile asphalt cement supply tank in order to facilitate the use of such asphalt cement in a CIR process. A heating assembly for asphalt cement comprises a heater and a heat modifying component. This heating assembly is interposed in the asphalt cement flow circuit between the asphalt cement supply tank and the component of the CIR train that is dispensing asphalt cement to be mixed with recycled paving material in the CIR process. More particularly, the heating assembly is located downstream of the asphalt cement supply tank and upstream of the component for dispensing asphalt cement to be mixed with recycled paving material. The heater component of the heating assembly comprises a burner and an asphalt cement coil. Asphalt cement to be heated is pumped through the asphalt cement coil, and the burner directs hot gases of combustion across the asphalt cement coil so that heat may be transferred from the hot gases to the asphalt cement flowing through the coil.

In some embodiments of the invention, the heater may include multiple asphalt cement coils across which hot gases of combustion are directed. In some embodiments, the heater may be provided with multiple burner nozzles, each of a different size, so that fuel can be selectively directed through nozzles of different sizes to change the heat output from the burner. In addition, the heater may also be provided with valves or other mechanisms that can change the fuel flow rate to the burner to change the heat output.

The heat modifying component of the heating assembly is adapted to modulate the amount of heat transfer from the hot gases of combustion to the asphalt cement in the asphalt cement coil in order to control the temperature of the asphalt cement in the asphalt cement flow circuit downstream of the heating assembly. This modulation is preferably carried out by modifying the air flow and/or the asphalt cement flow through the heater. In some embodiments of the invention, the heat modifying component comprises a by-pass valve that is arranged to blend unheated asphalt cement with asphalt cement that is heated by the heater in such a manner so as to obtain the desired asphalt cement temperature in the blend. In other embodiments of the invention, the heat modifying component comprises an air flow regulator assembly that controls the flow of the hot gases of combustion generated by the burner across the asphalt cement coil, in order to control the amount of heat transfer from the hot gases to the asphalt cement in the coil. In these embodiments of the invention, multiple exhaust vents are mounted to the heater, each of which is provided with a damper or other control mechanism that selectively allows or blocks the flow of hot gases of combustion across the asphalt cement coil of the heater. The exhaust vents and dampers are so located that operation of the dampers can change the path of hot gases of combustion within the heater, thereby changing the flow pattern of hot gases of combustion across the asphalt cement coil, and thereby changing the amount of heat transferred by the hot gases of combustion to the asphalt cement within the coil.

Preferably, the heating assembly is adapted to heat asphalt cement continuously as it is withdrawn from the asphalt cement supply tank, so as to continuously increase the temperature of the asphalt cement at a rate of about 1.0° F. per gallon at a flow rate of about 30 gallons/minute, or at a greater rate of temperature increase at a lower flow rate, or at a lesser rate of temperature increase at a higher flow rate, in order to insure that the asphalt cement that is discharged from the heating assembly is within a predetermined acceptable range of temperatures for use in the CIR process.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter described herein, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, in which arrows marked with "AC" indicate the direction of flow of asphalt cement and arrows marked "AF" indicate the direction of flow of heated air and gases of combustion, and wherein.

DESCRIPTION OF THE PREFERRED EMBODIMENTS OF THE INVENTION

Figure 1:
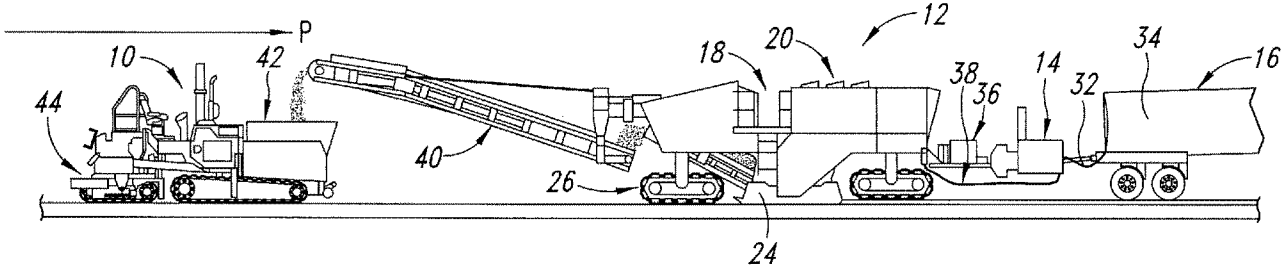
FIG. 1 is a side view of a CIR train comprised of an asphalt paving machine, a CIR-modified milling machine, a heater for asphalt cement and an asphalt cement supply truck.

This description of preferred embodiments of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

Figure 2:
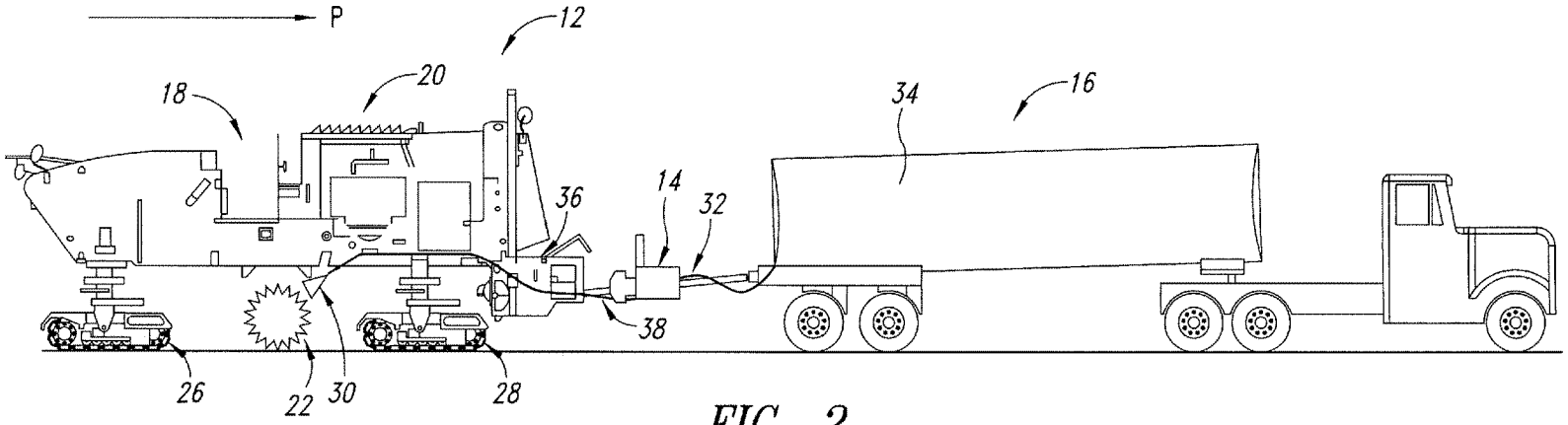
FIG. 2 is a side view of a portion of the CIR train of FIG. 1, with the CIR-modified milling machine illustrated somewhat schematically.
Figure 2A:
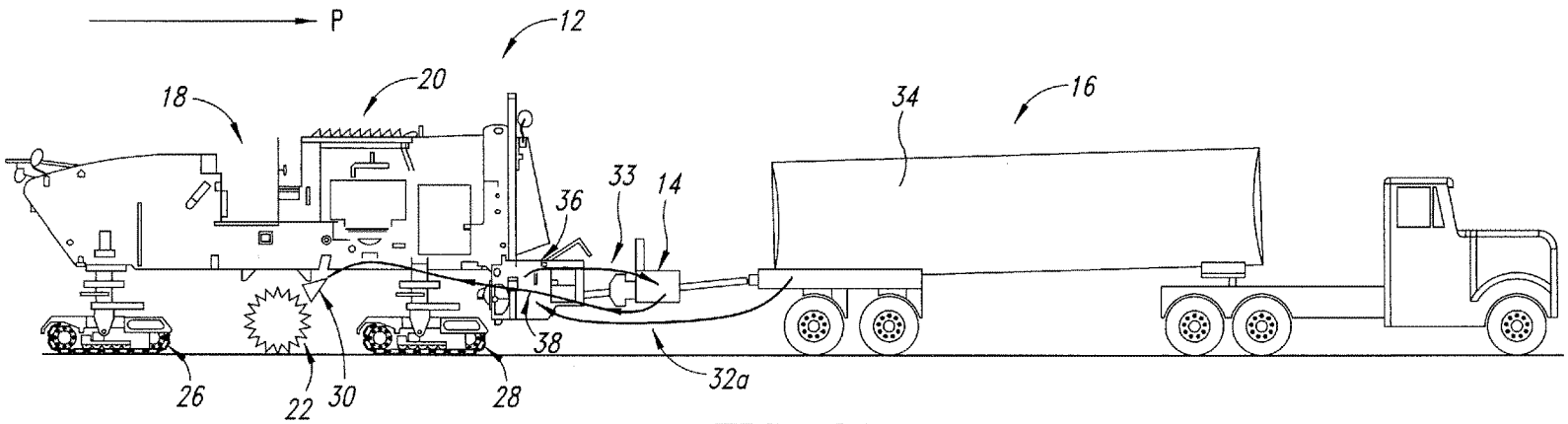
FIG. 2A is a side view of a portion of the CIR train that is similar to FIG. 2, showing an alternative asphalt cement flow circuit from the asphalt cement supply tank of the asphalt cement supply vehicle to the milling drum housing of the CIR-modified milling machine.

FIGS. 1, 2 and 2A illustrate a first CIR train comprised of asphalt paving machine 10 (not shown in FIGS. 2 and 2A), CIR-modified milling machine 12, heater 14 and asphalt cement supply truck 16. CIR-modified milling machine 12 includes operator's station 18 and an engine, typically a diesel engine (not shown) that is enclosed in engine compartment 20. Power from the engine is transmitted by a drive belt (not shown) or other means known to those having ordinary skill in the art to which the invention relates, to milling drum 22, which is located in a conventional milling drum housing 24 (not shown in FIGS. 2 and 2A for clarity). Milling drum 22 includes a plurality of cutter teeth that are adapted to mill the road surface as the milling drum rotates and the machine is advanced along the roadway in the processing direction "P".

Power from the engine is also transmitted, by means known to those having ordinary skill in the art to which the invention relates, to rear track drive assembly 26 and front track drive assembly 28. A CIR-modified milling machine may include one or two rear drive track assemblies (such as rear track drive assembly 26), and two front drive track assemblies (such as front track drive assembly 28). Some or all of these track drive assemblies can be turned to the left and to the right for steering purposes. Other embodiments of CIR-modified milling machines (not shown in the drawings) may include wheel drive assemblies instead of track drive assemblies. The drive assemblies are attached to lifting columns that include internal linear actuators (not shown) which can be activated to raise and lower the frame of the machine with respect to the roadway surface to change the depth of milling being carried out. Since milling drum 22 is mounted for rotation in milling drum housing 24 on the frame of the machine, raising the frame on the lifting columns can raise the milling drum out of contact with the roadway surface, and lowering the frame on the lifting columns can lower the milling drum into contact with the road surface so as to make a cut of the desired depth. Operator's station 18 includes all of the controls necessary for driving and steering the CIR-modified milling machine, rotating milling drum 22, and controlling all other operations of milling machine 12.

CIR-modified milling machine 12 includes asphalt cement spray assembly 30 that is mounted within the milling drum housing and adapted to dispense asphalt cement obtained from input supply line 32 which is in fluid communication with supply tank 34 on asphalt cement supply truck 16. Asphalt cement metering flow mechanism 36 is mounted on the front end of milling machine 12 and is in fluid communication with output supply line 38, heating assembly 14 and input supply line 32 from supply truck 16. Flow mechanism 36 comprises a pump that operates to draw asphalt cement from supply tank 34 of supply truck 16, through input supply line 32 into heater 14, and out of heater 14 through output supply line 38 to spray assembly 30, which dispenses asphalt cement into milling drum housing 24, where it mixes with paving material milled from the roadway. An alternative asphalt cement flow circuit from asphalt cement supply tank truck 16 to milling drum housing 24 of the CIR-modified milling machine is illustrated in FIG. 2A. As shown therein, flow mechanism or pump 36 operates to draw asphalt cement from supply tank 34 of supply truck 16, through input supply line 32*a* to pump 36, from pump 36 to heater 14 by heater input line 33, and from heater 14 to spray assembly 30 through output supply line 38. Regardless of the means by which asphalt cement is conveyed to spray assembly 30, the mixture of asphalt cement and milled material is then conveyed from milling drum housing 24 by conveyor 40 into hopper 42 at the front end of asphalt paving machine 10.

Paving machine 10 includes a conventional conveyor system comprising longitudinally disposed conveyors (not shown) and a transversely disposed screw auger (also not shown) for delivering the mixture of asphalt cement and recycled paving material from hopper 42 to a position just in advance of floating screed 44 where it is discharged onto the surface to be paved. The screed compacts and levels the asphalt mat on the repaired roadway.

Figure 3:
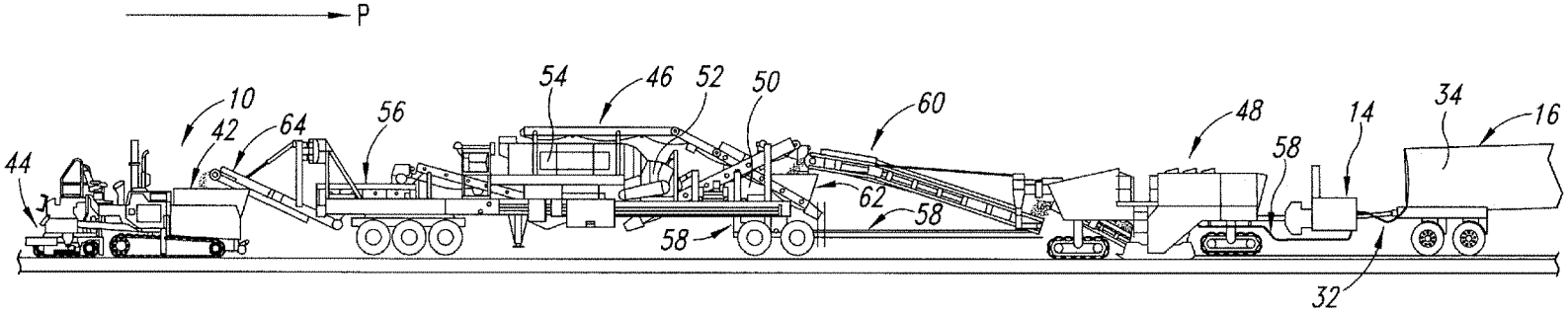
FIG. 3 is a side view of a CIR train comprised of an asphalt paving machine, a cold recycler machine, a milling machine, a heater for asphalt cement and an asphalt cement supply truck.

FIG. 3 illustrates a second embodiment of a CIR train that is adapted to traverse the roadway in the processing direction "P" as it recycles the pavement on the roadway. This CIR train is comprised of conventional asphalt paving machine 10, cold recycler machine 46, milling machine 48, heater 14 and asphalt cement supply truck 16. Cold recycler machine 46 includes asphalt cement storage tank 50, crusher 52, screen assembly 54 and pugmill 56. Milling machine 48 is a conventional milling machine. A pump (not shown) connected to asphalt cement storage tank 50 operates to draw asphalt cement from supply tank 34 of supply truck 16, through input supply line 32 into heater 14, and out of heater 14 through output supply line 58 to asphalt cement storage tank 50 on cold recycler machine 46. Milling machine 48 mills paving material from the roadway and conveys it via conveyor 60 into input hopper 62 on cold recycler machine 46. The material milled by the milling machine is then processed by cold recycler machine 46 by means of crusher 52 and screen assembly 54, and is conveyed into pugmill 56. Asphalt cement from asphalt cement storage tank 50 is also conveyed to and dispensed into pugmill 56 and mixed therein with the processed milled material. The mixture of asphalt cement and recycled paving material is then conveyed from the pugmill by conveyor 64 into hopper 42 at the front end of asphalt paving machine 10. The internal conveyor system in conventional paving machine 10 delivers the mixture of asphalt cement and recycled paving material from hopper 42 to a position just in advance of floating screed 44 where it is discharged onto the surface to be paved. Screed 44 compacts and levels the asphalt mat on the repaired roadway.

Figure 4:
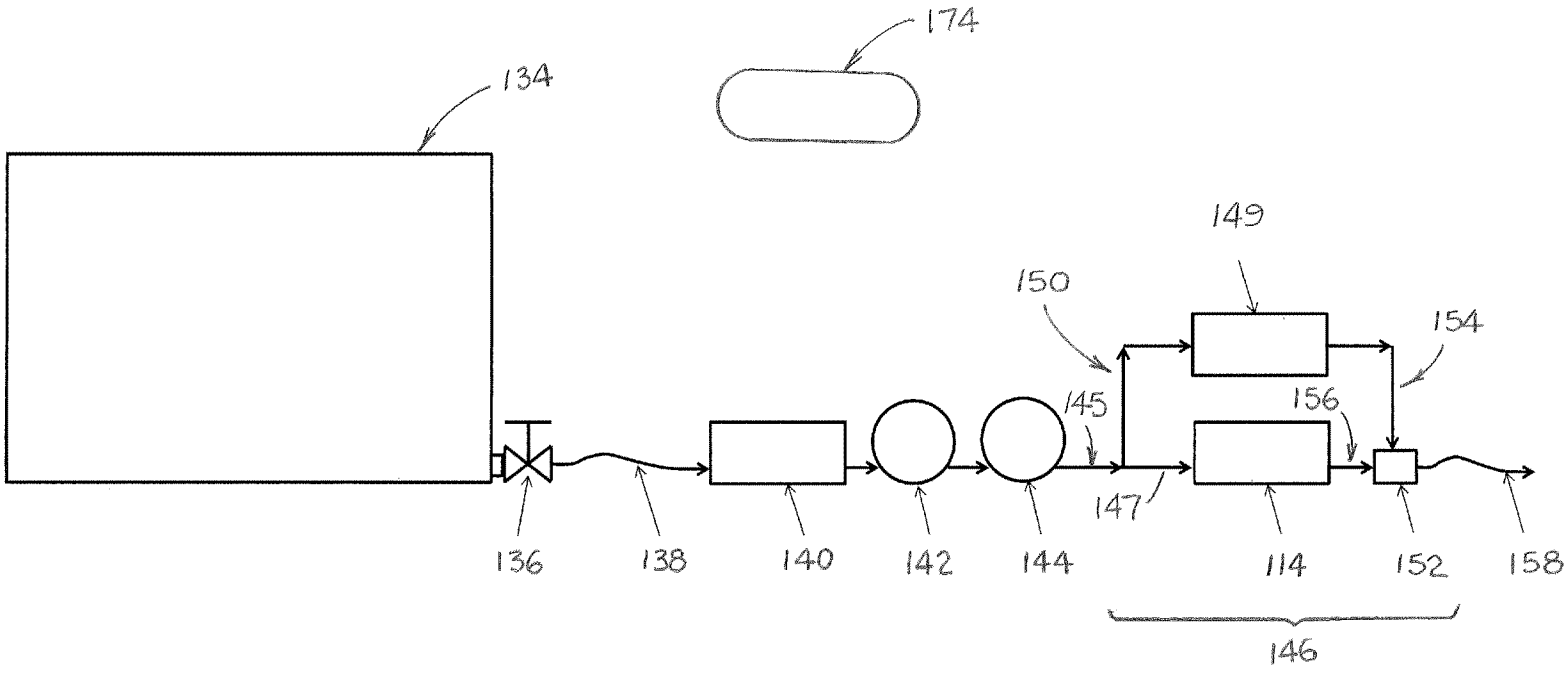
FIG. 4 is a schematic view of a portion of an alternative CIR train which includes a first embodiment of an asphalt cement flow circuit and a heater of the invention, and a heat modifying component that is arranged to blend unheated asphalt cement with asphalt cement that is heated by the heater in such a manner so as to obtain the desired asphalt cement temperature in the blend downstream of the heating assembly.

FIGS. 4-8 illustrate a first embodiment of a heating assembly including a heater and a heat modifying component that is arranged to modify the flow of asphalt cement through the asphalt cement coil of the heater in order to control the amount of heat transfer from hot gases generated in the heater to the asphalt cement in the coil. FIG. 4 is a schematic view of a portion of an alternative CIR train which includes asphalt cement supply tank 134 and an asphalt cement flow circuit comprising supply tank control valve 136 for controlling the flow of asphalt cement from supply tank 134, supply line 138, screen strainer 140 for removing impurities from the asphalt cement, asphalt cement pump 142, asphalt cement flow meter 144 for measuring the asphalt cement passing out of the asphalt cement pump, and input line 145 to heating assembly 146. FIG. 4 also illustrates schematically heater 114, heater inlet line 147 to heater 114, and heat modifying component 148. Heat modifying component 148 includes by-pass valve 149, by-pass input line 150 to by-pass valve 149, mixing tee 152, by-pass outlet line 154 to mixing tee 152, heater outlet line 156 to mixing tee 152 and output supply line 158 from mixing tee 152. In this embodiment of the invention, by-pass input line 150 to by-pass valve 149, mixing tee 152, by-pass outlet line 154 to mixing tee 152, and heater outlet line 156 to mixing tee 152 comprise by-pass fluid circuitry that is a part of the asphalt cement flow circuit.

The asphalt cement flow circuit illustrated in FIG. 4 provides fluid communication between and among supply tank 134 for asphalt cement, heating assembly 146 which is located downstream of supply tank 134, and a mechanism for dispensing asphalt cement on recycled paving material removed from a roadway by a milling machine in a CIR process. The heating assembly is adapted to heat the asphalt cement coming from the supply tank prior to its being dispensed on the recycled paving material that has been removed from the roadway. Heating assembly 146 may be a stand-alone unit located behind the asphalt cement supply truck, or it may be mounted to the asphalt cement supply truck, to a CIR-modified milling machine or to a cold recycler machine.

Figure 5:
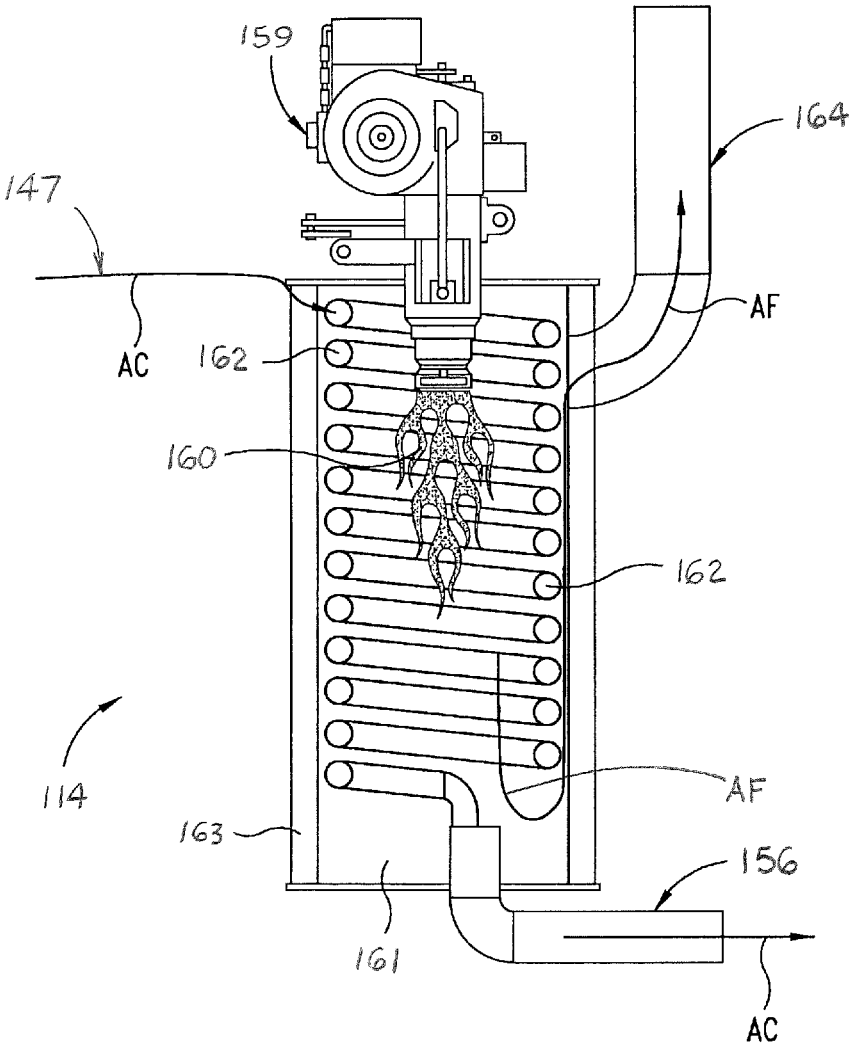
FIG. 5 is a sectional view of the first embodiment of the heater of the invention, illustrating the flow patterns of asphalt cement and heated air therethrough.
Figure 6:
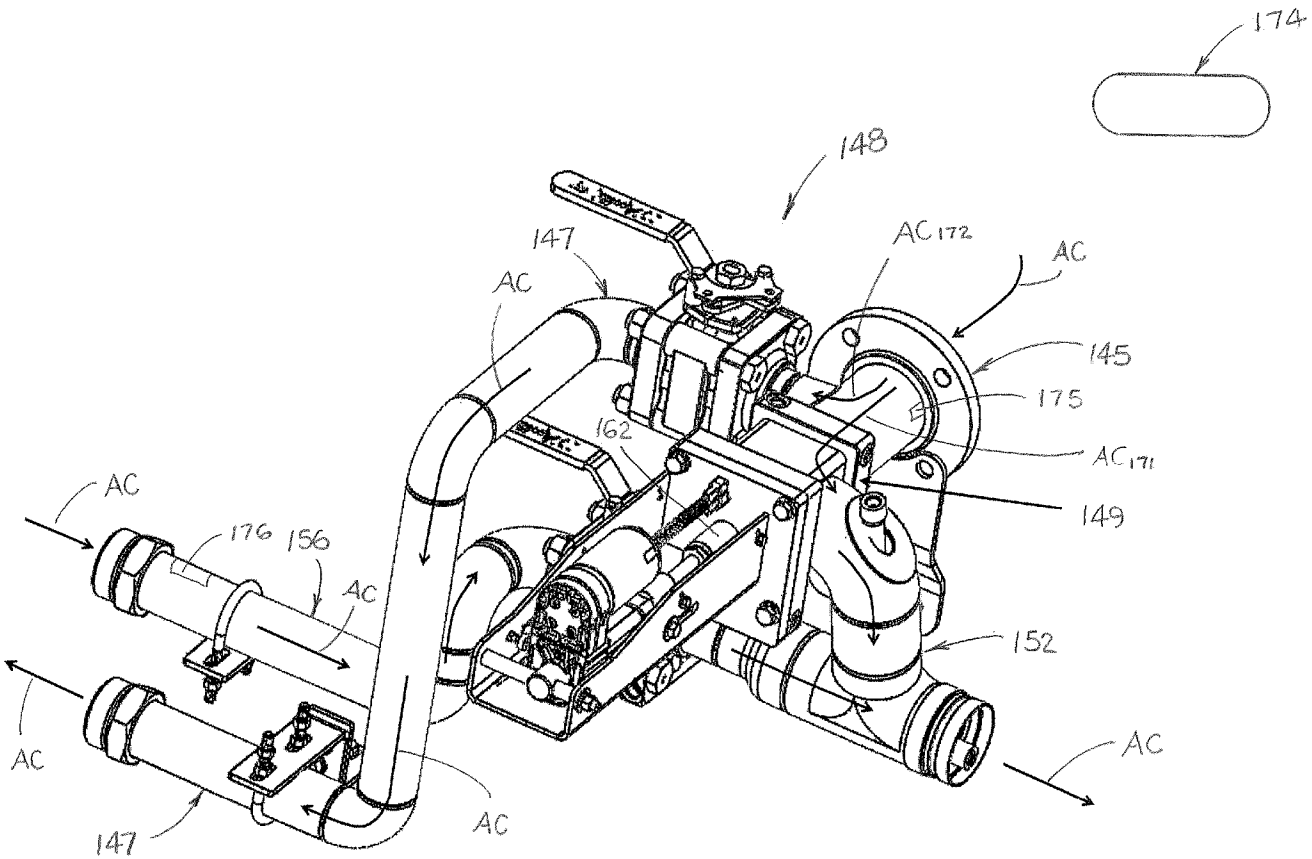
FIG. 6 is a perspective view of a preferred embodiment of the heat modifying component shown schematically in FIG. 4.

Heater 114 of heating assembly 146 is illustrated in some detail in FIG. 5. As shown therein, heater 114 includes burner 159 which is adapted to burn diesel fuel, propane or another fuel with air drawn from outside the heating assembly by an internal fan or blower (not shown) to create flame 160 and hot gases of combustion. The flame and hot gases of combustion are directed into a heating area of coil chamber 161 that is defined in part by asphalt cement coil 162. The asphalt cement coil is wrapped around the inside of coil chamber 161 in a helical pattern throughout its length. Surrounding the interior coil heating chamber 161 is outer insulation layer 163 which provides thermal insulation for heater 114. Asphalt cement coil 162 is part of the asphalt cement flow circuit illustrated in FIG. 4, and thus, is in fluid communication with asphalt cement inlet line 147 and asphalt cement heater outlet line 156. Burner 159 is arranged with respect to asphalt cement coil 162 so that the hot gases of combustion produced by the burner can pass through and around asphalt cement coil 162 in coil chamber 161 in order to transfer heat to the asphalt cement being pumped through asphalt cement coil 162 by pump 142. Exhaust gases from interior heating chamber 161 are vented out of heater 114 through exhaust vent 166, which is in fluid communication with the interior heating chamber.

Figure 7:
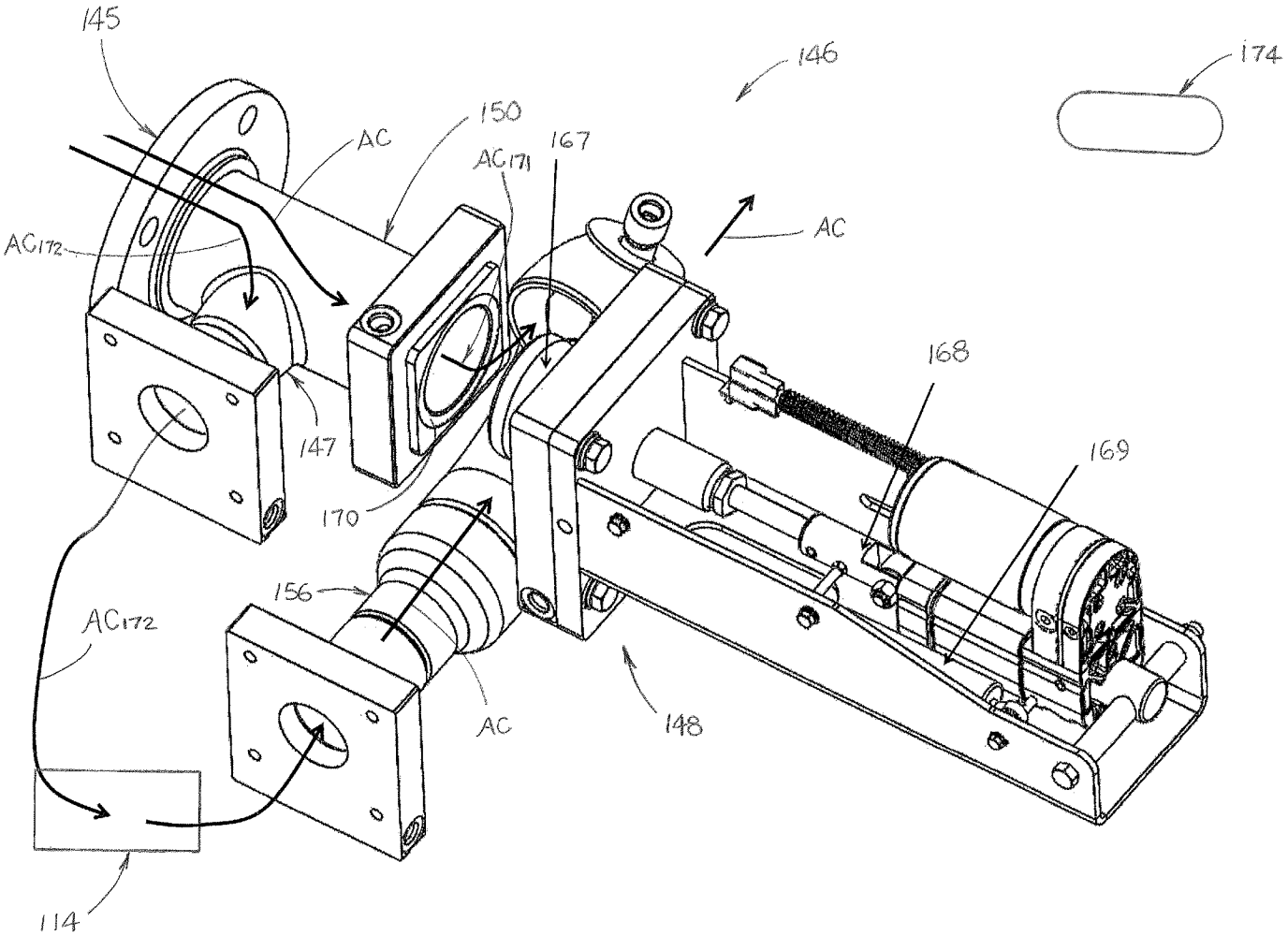
FIG. 7 is a perspective view of a portion of the heat modifying component shown in FIG. 6, taken from a different perspective from that shown in FIG. 6, with portions of the assembly removed to show the by-pass valve of the heat modifying component in an open position.

FIGS. 4 and 6-8 illustrate heat modifying component 148 for heating assembly 146, and a preferred asphalt cement flow circuit that is associated therewith. As shown therein, asphalt cement from supply tank 134 is pumped by asphalt cement pump 142 past asphalt cement flow meter 144 into input line 145 of heating assembly 146. By-pass valve 149 includes valve disk 167 (shown in FIGS. 7 and 8) that is attached to linear actuator 168 and adapted to move between one or more open positions, including the open position shown in FIG. 7, and a closed position shown in FIG. 8. The by-pass valve is also in an open position in FIG. 6. Heat modifying component 148 also includes linear position sensor 169 (shown in FIGS. 7 and 8) that is adapted to determine the location of valve disk 167 with respect to valve seat 170 at any time. When by-pass valve disk 167 is in an open position, such as is shown in FIG. 7, a portion of the asphalt cement entering heating assembly 146 through input line 145 passes through by-pass input line 150 and into by-pass valve 149, and from by-pass valve 149 into mixing tee 152 as shown by asphalt cement flow line $AC_{171}$. This portion of the asphalt cement by-passes the heater. Another portion of the asphalt cement entering through input line 145 passes through heater inlet line 147, as shown by asphalt cement flow line $AC_{172}$, to heater 114, and from heater 114 through heater outlet line 156 into mixing tee 152. Depending on the relative position of by-pass valve disk 167 with respect to valve seat 170 (best shown in FIG. 7), as controlled by a controller such as controller 174, a greater or lesser portion of the asphalt cement entering through input line 145 will be directed to heater 114, so that the relative proportion of heated asphalt cement passing out of mixing tee 152 can be modulated to obtain the desired asphalt cement temperature downstream of the heating assembly. On the other hand, when by-pass valve disk 167 is in the closed position on the valve seat, all of the asphalt cement entering heating assembly 146 through input line 145 passes through heater inlet line 147, as shown by flow line $AC_{172}$, to heater 114, and from heater 114 through heater outlet line 156 into mixing tee 152. Thus, when the by-pass valve is closed, all of the asphalt cement entering through input line 145 of heating assembly 146 will be heated in heater 114.

Both linear actuator 168 and linear position sensor 169 are operatively attached to controller 174, shown schematically in FIGS. 4 and 6-8, which is preferably mounted in the operator's station of a CIR-modified milling machine such as CIR-modified milling machine 12 or a cold recycler machine such as cold recycler machine 46. Controller 174 is also operatively connected to asphalt cement pump 142, asphalt cement flow meter 144 and asphalt cement heater 114. Controller 174 is also operatively connected to temperature sensor 175, located in input line 145 into heating assembly 146, and to temperature sensor 176, located in heater outlet line 156. The controller is adapted to receive temperature information from these temperature sensors in order to control the temperature of asphalt cement passing through output supply line 158 to a modified milling machine such as modified milling machine 12 or to a cold recycler machine such as cold recycler machine 46.

Controller 174 may embody a single microprocessor or multiple microprocessors that include components for controlling the temperature of the asphalt cement used in the CIR process, as well as components for controlling the operations of modified milling machine 12 or cold recycler machine 46, based on input from a machine operator and on sensed or other known operational parameters. Controller 174 may include a memory, a secondary storage device, a processor and other components for running an application. Various other circuits may be associated with controller 174 such as power supply circuitry, signal conditioning circuitry, solenoid driver circuitry and other types of circuitry. Numerous commercially available microprocessors can be configured to perform the functions of controller 174. It should be appreciated that controller 174 could readily be embodied in a general purpose computer or machine microprocessor capable of controlling numerous machine functions for a modified milling machine such as modified milling machine 12 or a cold recycler machine such as cold recycler machine 46.

Figure 9:
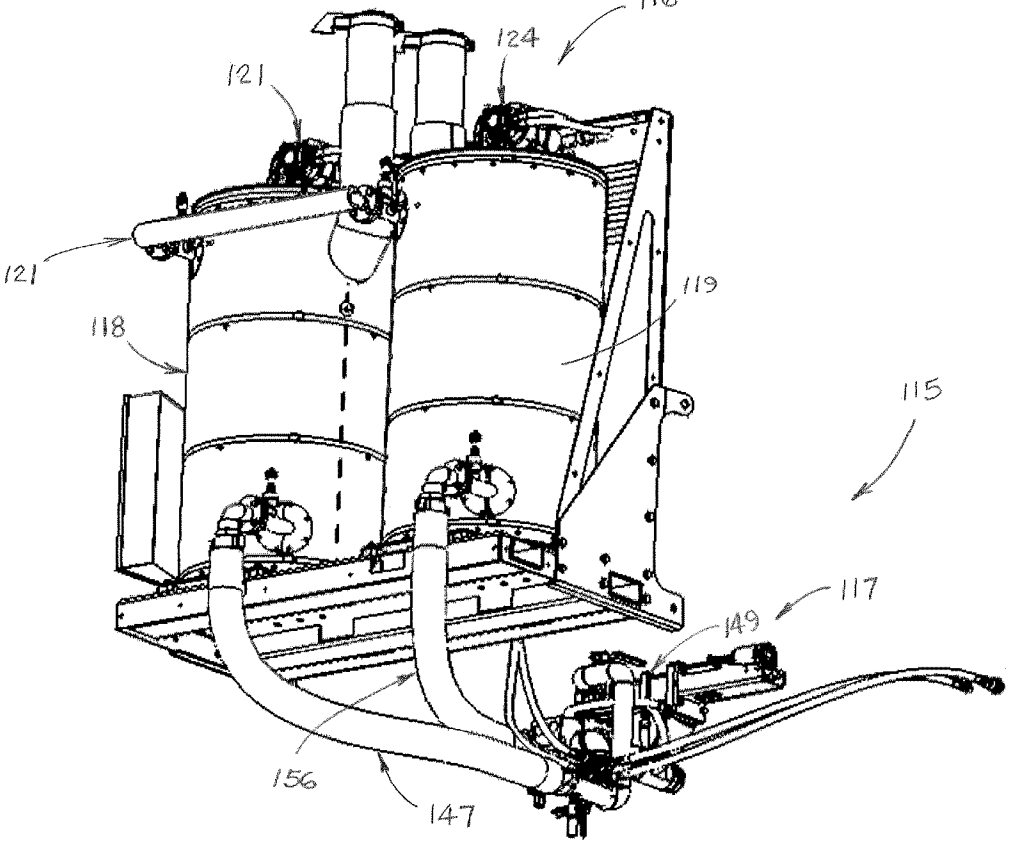
FIG. 9 is a perspective view of a second embodiment of the heating assembly of the invention, which heating assembly comprises a dual heater and the heat modifying component shown in FIGS. 6-8.
Figure 10:
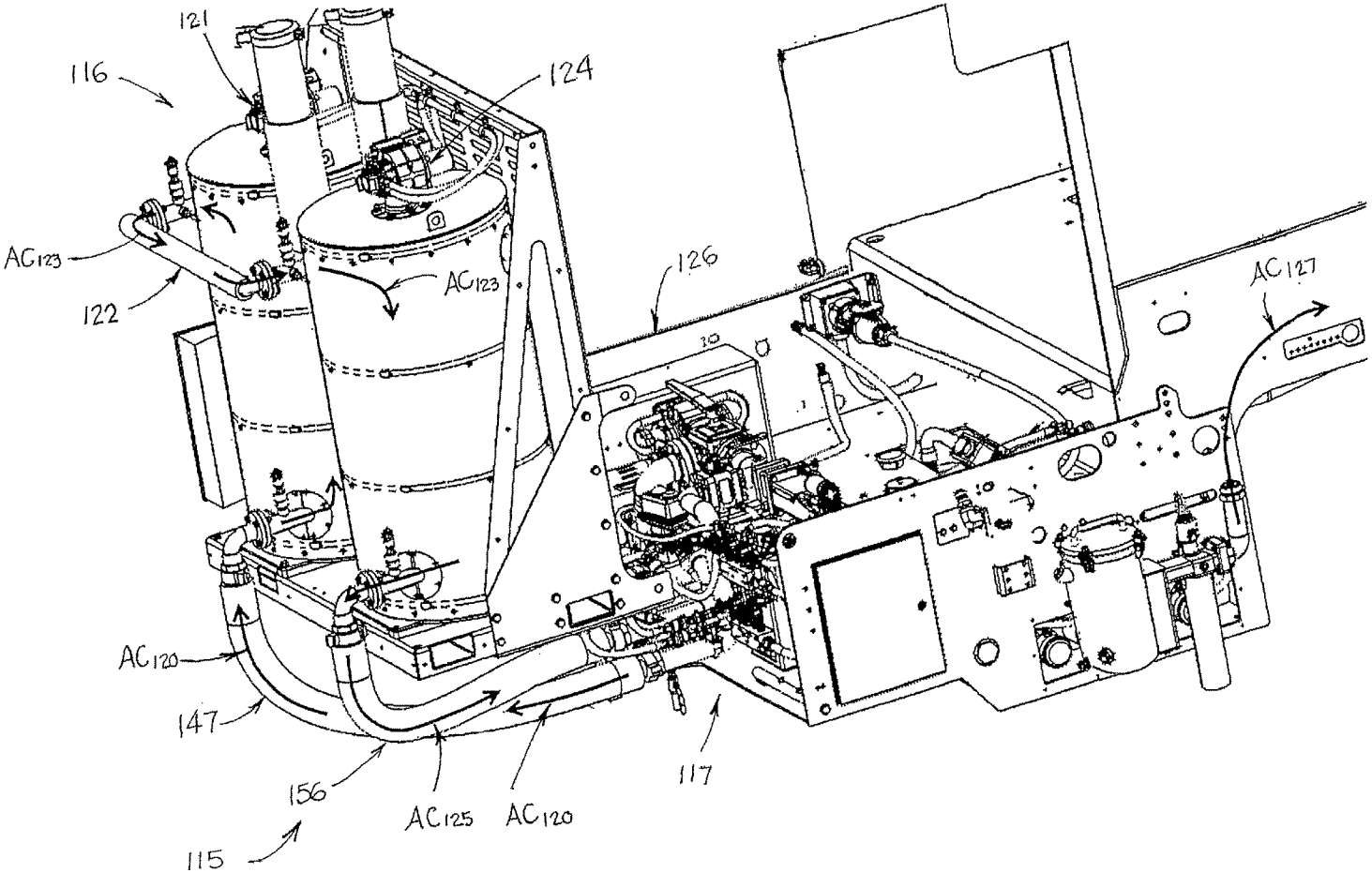
FIG. 10 is a perspective view of the heating assembly shown in FIG. 9, illustrating the attachment of the heating assembly to a milling machine.

FIGS. 9 and 10 illustrate a second embodiment of a heating assembly of the invention, comprising heating assembly 115, which includes dual heater 116 and heat modifying component 117. Dual heater 116 comprises a pair of heaters 118 and 119 that are joined together in series, each of which is substantially identical to heater 114 shown in FIG. 5. Dual heater 116 can be substituted for heater 114 in the schematic view of heating assembly 146 shown in FIG. 4. Heat modifying component 117 includes by-pass valve 149 and associated components of the asphalt cement flow circuit that are associated therewith. When by-pass valve 149 is open position (as shown in FIG. 7), a portion of the asphalt cement entering heating assembly 115 through input line 145 (not shown in FIGS. 9 and 10) passes through by-pass input line 150 (also not shown in FIGS. 9 and 10) and into by-pass valve 149, and from by-pass valve 149 into mixing tee 152 (not shown in FIGS. 9 and 10). This portion of the asphalt cement by-passes the heater. Another portion of the asphalt cement entering through input line 145 passes through heater inlet line 147 as shown by flow line $AC_{120}$ in FIG. 10, into an asphalt cement coil in heater 118 (not shown but substantially similar to asphalt cement coil 162 of heater 114) to be heated by contact with hot gases of combustion generated by burner 121. The asphalt cement that is heated in heater 118 passes out of heater 118 through cross-over line 122 as shown by flow line $AC_{123}$ in FIG. 10, and into heater 119. Cross-over line 122 is in fluid communication with an asphalt cement coil in heater 119 (not shown), so that the asphalt cement in the asphalt cement coil may be heated by contact with hot gases of combustion generated by burner 124. The asphalt cement from heater 119 passes out of heater 119 through heater outlet line 156 as shown by flow line $AC_{125}$, and into mixing tee 152 (not shown in FIGS. 9 and 10). Depending on the relative position of by-pass valve disk 167 with respect to valve seat 170 in by-pass valve 149, as controlled by a controller such as controller 174, a greater or lesser portion of the asphalt cement entering through input line 145 will be directed to dual heater 116, so that the relative proportion of heated asphalt cement passing out of mixing tee 152 can be modulated to obtain the desired asphalt cement temperature downstream of the heating assembly. On the other hand, when by-pass valve disk 167 is in the closed position on the valve seat of by-pass valve 149, all of the asphalt cement entering heating assembly 115 through input line 145 passes through heater inlet line 147 to dual heater 116 (comprising heaters 118 and 119), and from dual heater 116 through heater outlet line 156 into mixing tee 152. Thus, when the by-pass valve is closed, all of the asphalt cement entering through input line 145 of heating assembly 115 will be heated in dual heater 116. As shown in FIG. 10, heating assembly 115 may be mounted on frame 126 of a milling machine such as modified milling machine 12. In this embodiment of the invention, whether by-pass valve 149 is open or closed, asphalt cement passes out of mixing tee 152 through an output supply line such as output supply line 158 (not shown in FIGS. 9 and 10) as shown by flow line $AC_{127}$, to a spray assembly such as spray assembly 30, which dispenses the asphalt cement into a milling drum housing where it mixes with paving material milled from the roadway.

Figure 11:
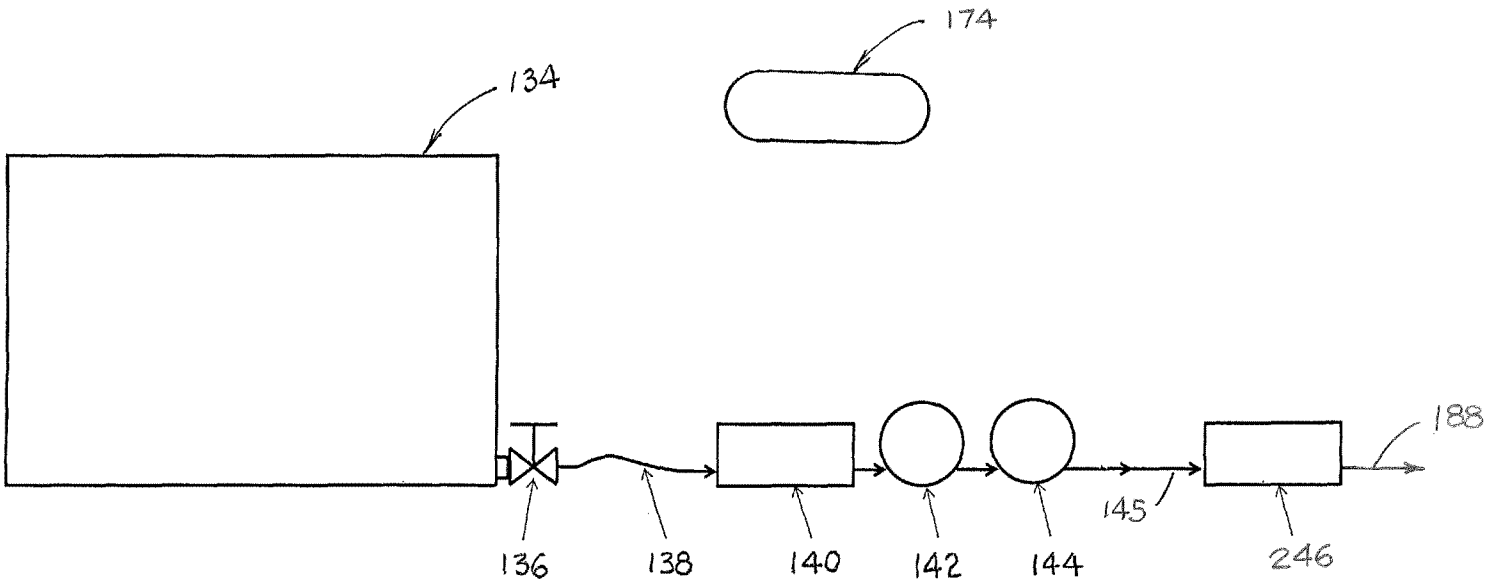
FIG. 11 is a schematic view of a portion of an alternative CIR train which includes a third embodiment of the heating assembly of the invention including a heat modifying component that is arranged to modify the flow of hot gases of combustion from the burner of the heater in order to control the amount of heat transfer from the hot gases to the asphalt cement in the asphalt cement coil of the heater.

FIGS. 11-16 illustrate a third embodiment of a heating assembly including a heater and a heat modifying component that is arranged to modify the flow of hot gases of combustion from the burner of the heater across the asphalt cement coil in order to control the amount of heat transfer from the hot gases generated by the burner to the asphalt cement in the coil. FIG. 11 provides a schematic view of a portion of an alternative CIR train which includes asphalt cement supply tank 134 and an asphalt cement flow circuit comprising supply tank control valve 136 for controlling the flow of asphalt cement from supply tank 134, supply line 138, screen strainer 140 for removing impurities from the asphalt cement, asphalt cement pump 142, asphalt cement flow meter 144 for measuring the asphalt cement passing out of the asphalt cement pump, and input line 145 to heating assembly 246. As shown in FIGS. 12-16, heating assembly 246 includes heater 214 which is equipped with burner 177. Burner 177 is operatively connected to controller 174 and is adapted to burn diesel fuel, propane or another fuel with air drawn from outside the burner assembly by an internal fan or blower (not shown) to create flame 178 (shown in FIGS. 13 and 15) and hot gases of combustion that are directed into coil chamber 180 that is defined in part by outer wall 182. Asphalt cement coil 184 is part of the asphalt cement flow circuit and is in fluid communication with asphalt cement inlet 186 and asphalt cement outlet 188, so that the hot gases of combustion produced by burner 177 can pass through and around asphalt cement coil 184 in coil chamber 180 in order to transfer heat to the asphalt cement being pumped through asphalt cement coil 184 by pump 142, as controlled by controller 174.

Figure 8:
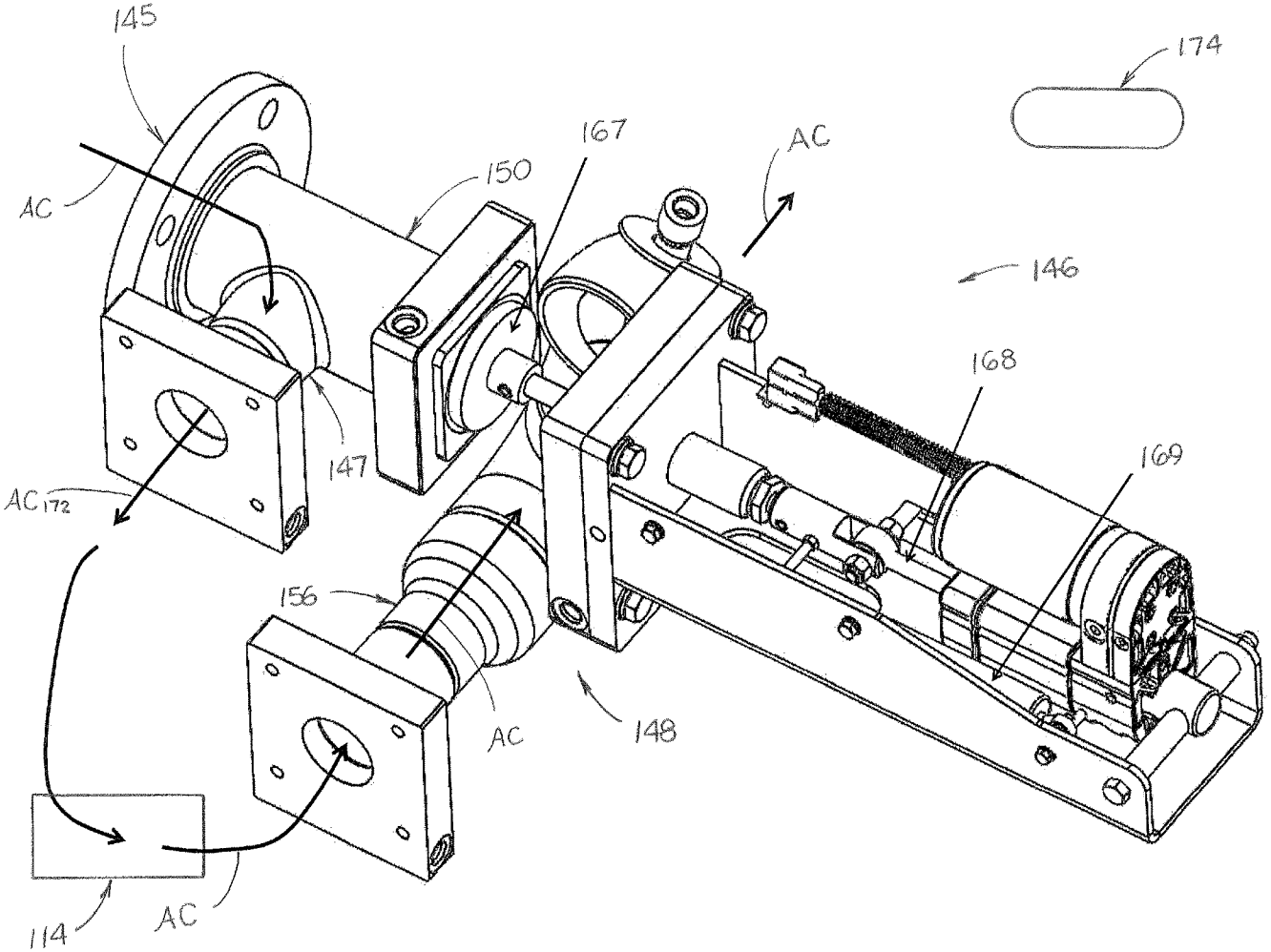
FIG. 8 is a perspective view of the portion of the heat modifying component shown in FIG. 7, showing the by-pass valve of the heat modifying component in a closed position.
Figure 14:
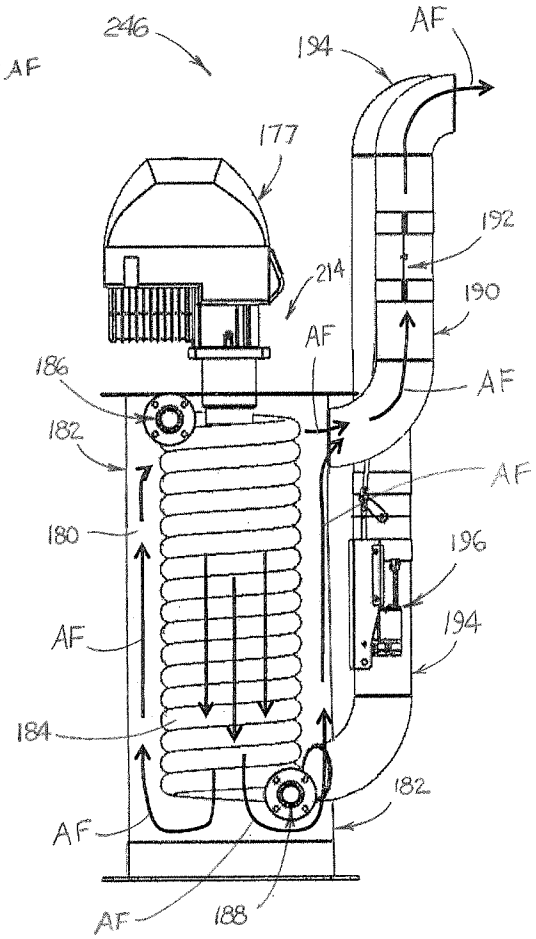
FIG. 14 is a sectional view of the third embodiment of the heating assembly shown in FIGS. 12 and 13, illustrating the flow of heated air and gases of combustion across the asphalt cement coil when operated according to the first gas-flow configuration.
Figure 13:
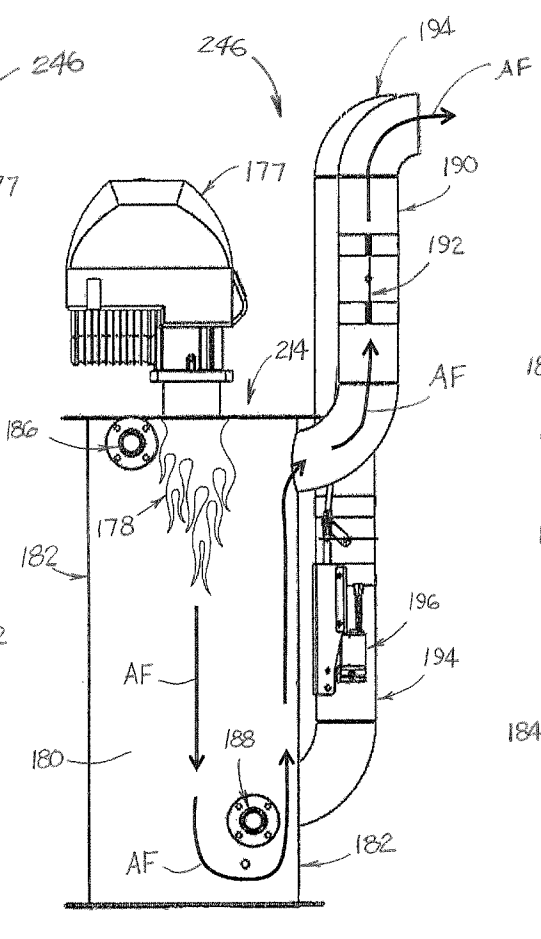
FIG. 13 is a sectional view of the third embodiment of the heating assembly shown in FIG. 12, with the asphalt cement coil removed, illustrating the flow of heated air and gases of combustion through the heater when operated according to a first gas-flow configuration.
Figure 12:
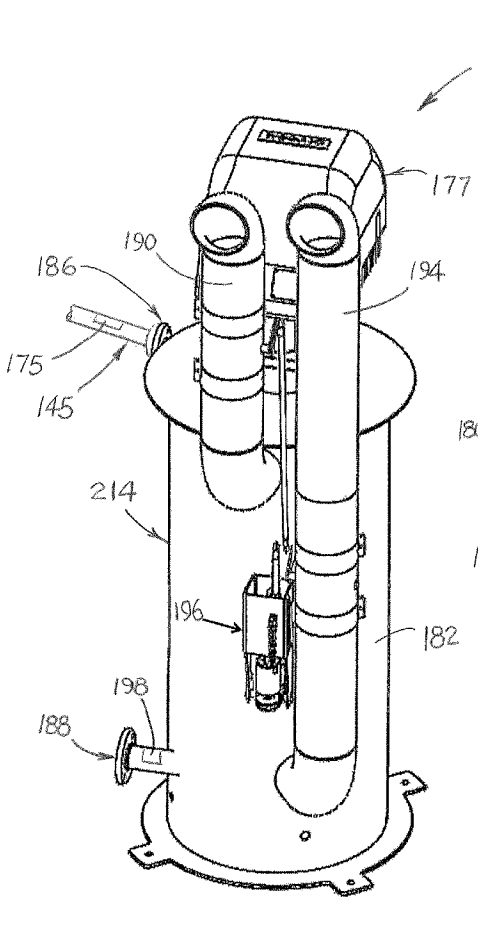
FIG. 12 is a perspective view of the third embodiment of the heating assembly of the invention.
Figure 16:
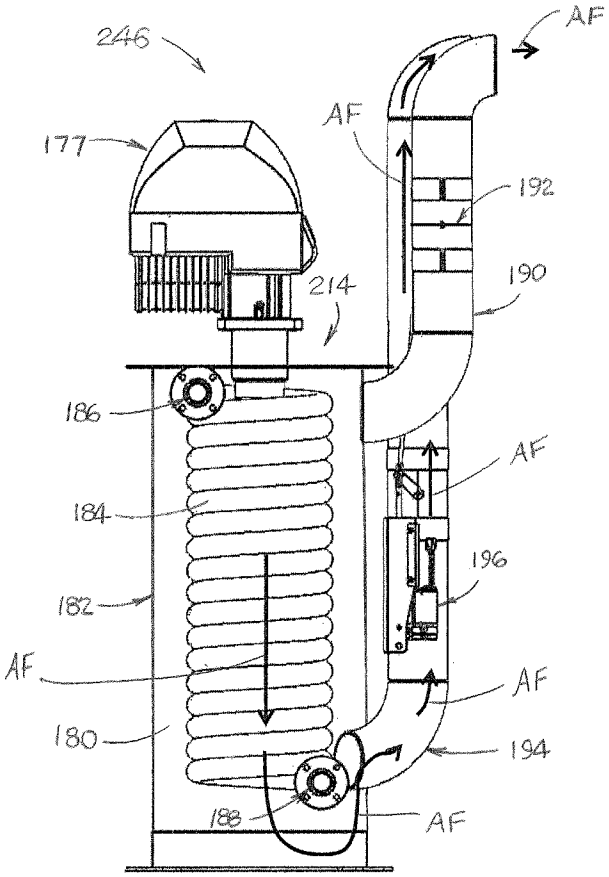
FIG. 16 is a sectional view of the third embodiment of the heating assembly shown in FIGS. 12-15, illustrating the flow of heated air and gases of combustion across the asphalt cement coil when operated according to the second gas-flow configuration.
Figure 15:
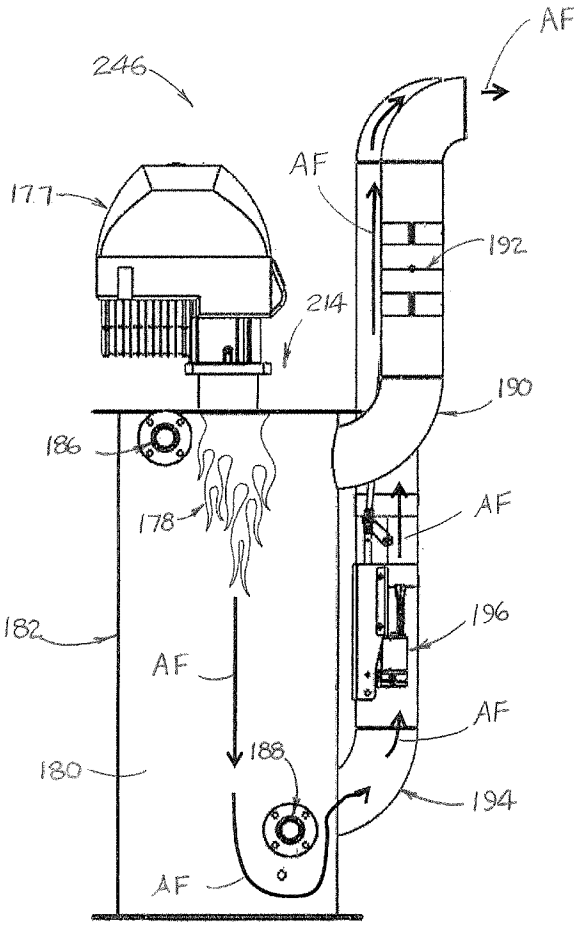
FIG. 15 is a sectional view of the third embodiment of the heating assembly shown in FIGS. 12-14, with the asphalt cement coil removed, illustrating the flow of heated air and gases of combustion through the heater when operated according to a second gas-flow configuration.

Heating assembly 246 includes a heat modifying component comprising an air flow regulator assembly that is operatively attached to heater 214. More specifically, the air flow regulator assembly comprises upper exhaust vent 190 with upper damper 192 mounted therein, and lower exhaust vent 194 with a lower damper (not shown, but substantially identical to upper damper 192) mounted therein. Both upper exhaust vent 190 and lower exhaust vent 194 are mounted so as to be in fluid communication with coil chamber 180. In addition, both upper damper 192 and the lower damper are controlled by linear actuator 196 that is operatively attached to controller 174, so that either upper damper 192 is open and the lower damper is closed (as shown in FIGS. 13 and 14), allowing the hot gases of combustion to flow downwardly through and upwardly along the sides of asphalt cement coil 184 before exiting coil chamber 180, or the lower damper is open and upper damper 192 is closed (as shown in FIGS. 15 and 16), allowing the hot gases of combustion to flow downwardly through the asphalt cement coil and then out of coil chamber 180. Heating assembly 246 also includes a linear position sensor (not shown, but similar to linear position sensor 169 that is shown in FIGS. 7 and 8) that is associated with linear actuator 196 and is adapted to determine the amount of extension of linear actuator 196, and hence whether upper damper 192 and the lower damper are open or closed. A heating assembly similar to heating assembly 246 may include a dual heater such as dual heater 116, comprising heaters 118 and 119, either or both of which are provided with an air flow regulator assembly such as is illustrated in FIGS. 12-16.

Burners 159, 121, 124 and 177 are preferably multi-stage burners that may be configured in any of various ways. The SDC Series oil burner sold by the Beckett Corporation of North Ridgeville, Ohio has a single fuel nozzle that operates according to two different pressure ranges to produce two different heat outputs. The RG5D light oil burner sold by Riello S.p.A. of Legnago, Italy has two fuel nozzles that operate according to different flow rates to produce two different heat outputs. The WL20 oil burner sold by Weishaupt Corporation of Mississauga, Ontario has two solenoids that operate to supply two different flow rates to a single nozzle to produce two different heat outputs. Other burner assemblies may be employed that are adapted to produce one or more than one heat output. Preferably, a burner is employed that is adapted to produce a maximum of at least about 400,000 BTUs per hour.

During the operation of a modified milling machine or a cold recycler machine according to the embodiment of the invention illustrated in FIGS. 11-16, the operator may select a desired temperature of asphalt cement passing out of heating assembly 246 by way of asphalt cement outlet 188 through output supply line 158 to a modified milling machine such as modified milling machine 12 or to a cold recycler machine such as cold recycler machine 46. When this desired temperature is input into controller 174, the controller will use this information and: (1) the input asphalt cement temperature obtained from sensor 175 located in input line 145 to asphalt cement inlet 186 of heating assembly 246, (2) the output asphalt cement temperature obtained from sensor 198 located in asphalt cement outlet 188 of heater 214, (3) input from the linear position sensor associated with linear actuator 196 of heating assembly 246, and (4) the flow rate of pump 142 (obtained from asphalt cement flow meter 144) to control: (a) asphalt cement pump 142, (b) burner 177, and (c) linear actuator 196 (which controls both upper damper 192 and the lower damper associated with heater 214) to produce the desired output temperature of asphalt cement passing through asphalt cement output 188 to an output supply line to a modified milling machine such as modified milling machine 12 or to a cold recycler machine such as cold recycler machine 46.

Preferably, heating assembly 246 is adapted to heat asphalt cement continuously as it is withdrawn from the asphalt cement supply tank, so as to continuously increase the temperature of the asphalt cement at a rate of about 1.0° F. per gallon at a flow rate of about 30 gallons/minute, or at a greater rate of temperature increase at a lower flow rate, or at a lesser rate of temperature increase at a higher flow rate, in order to insure that the asphalt cement that is discharged from the heater is within a predetermined acceptable range of temperatures for use in the CIR process.

Heating assembly 246 is located downstream of supply tank 134 in an asphalt cement flow circuit that is in fluid communication with a mechanism for dispensing asphalt cement on recycled paving material removed from a roadway by a milling machine in a CIR process. The heating assembly is adapted to heat the asphalt cement coming from the supply tank prior to its being dispensed on the recycled paving material that has been removed from the roadway. Heating assembly 246 may be a stand-alone unit located behind the asphalt cement supply truck, or it may be mounted to the asphalt cement supply truck, to a CIR-modified milling machine or to a cold recycler machine.

Although this description contains many specifics, these should not be construed as limiting the scope of the invention but as merely providing illustrations of the presently preferred embodiments thereof, as well as the best modes contemplated by the inventors for carrying out the invention. The invention, as described and claimed herein, is susceptible to various modifications and adaptations, as would be understood by those having ordinary skill in the art to which the invention relates.

What is claimed is:

1. A CIR train that is adapted to traverse a roadway of pavement in order to remove paving material from the pavement and recycle such paving material by mixing it with asphalt cement, said CIR train comprising:

(A) a milling machine for milling the pavement and removing milled paving material from the roadway;

(B) an asphalt cement supply tank that is separate from the milling machine;

(C) a mechanism for dispensing asphalt cement onto paving material that has been removed from the roadway by the milling machine;

(D) an asphalt cement flow circuit that provides for the flow of asphalt cement from the asphalt cement supply tank to the mechanism for dispensing asphalt cement onto the paving material that has been removed from the roadway, said asphalt cement flow circuit including an asphalt cement pump for pumping asphalt cement from the asphalt cement supply tank into and through the asphalt cement flow circuit;

(E) a heating assembly that is interposed in the asphalt cement flow circuit between the asphalt cement supply tank and the mechanism for dispensing asphalt cement onto paving material that has been removed from the roadway, said heating assembly comprising:

(i) a heater comprising:

(a) an asphalt cement coil that is in the asphalt cement flow circuit;

(b) a burner that is adapted to direct hot gases of combustion across the asphalt cement coil through which asphalt cement is being pumped;

(ii) a heat modifying component that is adapted to modulate the amount of heat transfer from the hot gases of combustion to the asphalt cement in the coil in order to control the temperature of the asphalt cement in the asphalt cement flow circuit downstream of the heating assembly, wherein the heat modifying component modulates the amount of heat transfer from the hot gases of combustion to the asphalt cement in the coil by modifying the flow of asphalt cement through the asphalt cement coil or by modifying the flow of hot gases of combustion from the burner of the heater across the asphalt cement coil.

2. The CIR train of claim 1 wherein the asphalt cement supply tank is mounted on an asphalt cement supply truck.

3. The CIR train of claim 1 wherein the heater is adapted to provide continuous-flow heating of the asphalt cement coming from the asphalt cement supply tank.

4. The CIR train of claim 1 wherein the heater comprises a pair of asphalt cement coils that are connected in series in the asphalt cement flow circuit.

5. The CIR train of claim 1 wherein the asphalt cement flow circuit comprises an input line for asphalt cement into the heating assembly, and an output line for asphalt cement from the heating assembly.

6. The CIR train of claim 5:

(A) which includes a mixing tee that is located between the heater and the output line for asphalt cement from the heating assembly;

(B) wherein the heat modifying component includes by-pass fluid circuitry and a by-pass valve that is adapted to move between:

(i) one or more open positions in which at least a portion of the asphalt cement entering the heating assembly through the input line is conveyed into the mixing tee without passing through the heater; and (ii) a closed position in which all of the asphalt cement entering the heating assembly through the input line will be heated in the heater and then conveyed into the mixing tee.

7. The CIR train of claim 6:

(A) wherein the heat modifying component includes a linear actuator;

(B) wherein the by-pass valve includes a valve disk and a valve seat, which valve disk is attached to the linear actuator and is adapted to move between one or more open positions with respect to the valve seat and a closed position on the valve seat;

(C) wherein the heat modifying component includes a linear position sensor that is adapted to determine the location of the valve disk with respect to the valve seat.

8. A CIR train that is adapted to traverse a roadway of pavement in order to remove paving material from the pavement and recycle such paving material by mixing it with asphalt cement, said CIR train comprising:

(A) a milling machine for milling the pavement and removing milled paving material from the roadway;

(B) an asphalt cement supply tank that is separate from the milling machine;

(C) a mechanism for dispensing asphalt cement onto paving material that has been removed from the roadway by the milling machine;

(D) a heating assembly;

(E) an asphalt cement flow circuit that provides for the flow of asphalt cement from the asphalt cement supply tank to the mechanism for dispensing asphalt cement onto the paving material that has been removed from the roadway, said asphalt cement flow circuit comprising:

(i) an input line for asphalt cement into the heating assembly;

(ii) an output line for asphalt cement from the heating assembly;

(iii) an asphalt cement pump for pumping asphalt cement from the asphalt cement supply tank into and through the asphalt cement flow circuit;

(F) wherein the heating assembly is interposed in the asphalt cement flow circuit between the asphalt cement supply tank and the mechanism for dispensing asphalt cement onto paving material that has been removed from the roadway, said heating assembly further comprising:

(i) a heater comprising:

(a) an asphalt cement coil that is in the asphalt cement flow circuit, (b) a burner that is adapted to direct hot gases of combustion across the asphalt cement coil through which asphalt cement is being pumped;

(ii) a mixing tee that is located between the heater and the output line for asphalt cement from the heating assembly;

(iii) a heat modifying component that is adapted to modify the flow of asphalt cement through the asphalt cement coil in order to control the amount of heat transfer from the hot gases of combustion to the asphalt cement in the asphalt cement coil, said heat modifying component comprising:

(a) a by-pass valve that is adapted to move between one or more open positions in which at least a portion of the asphalt cement entering the heating assembly through the input line is conveyed into the mixing tee without passing through the heater, and a closed position in which all of the asphalt cement entering the heating assembly through the input line will be heated in the heater and then conveyed into the mixing tee;

(b) a linear actuator;

(G) wherein the by-pass valve includes a valve disk and a valve seat, which valve disk is attached to the linear actuator and is adapted to move between one or more open positions with respect to the valve seat and a closed position on the valve seat;

(H) wherein the heat modifying component includes a linear position sensor that is adapted to determine the location of the valve disk with respect to the valve seat;

(I) a controller;

(J) an outlet line for asphalt cement from the heater to the mixing tee;

(K) a temperature sensor that is located in the input line for asphalt cement into the heating assembly;

(L) a temperature sensor that is located in the outlet line from the heater to the mixing tee;

(M) wherein the controller is operatively attached to the temperature sensor that is located in the input line, the temperature sensor that is located in the outlet line, the linear actuator, the linear position sensor, the by-pass valve, the asphalt cement pump, the asphalt cement flow meter and the heater;

(N) wherein the controller is adapted to receive temperature information from the temperature sensors located in the input line for asphalt cement into the heating assembly and in the outlet line from the heater to the mixing tee and use such information to control the flow of asphalt cement from the pump and the operation of the heater and the by-pass valve in order to obtain a desired temperature of asphalt cement passing through the output line for asphalt cement from the heating assembly.

9. A CIR train that is adapted to traverse a roadway of pavement in order to remove paving material from the pavement and recycle such paving material by mixing it with asphalt cement, said CIR train comprising:

(A) a milling machine for milling the pavement and removing milled paving material from the roadway;

(B) an asphalt cement supply tank that is separate from the milling machine;

(C) a mechanism for dispensing asphalt cement onto paving material that has been removed from the roadway by the milling machine;

(D) a heating assembly;

(E) an asphalt cement flow circuit that provides for the flow of asphalt cement from the asphalt cement supply tank to the mechanism for dispensing asphalt cement onto the paving material that has been removed from the roadway, said asphalt cement flow circuit comprising:

(i) an input line for asphalt cement into the heating assembly;

(ii) an output line for asphalt cement from the heating assembly;

(iii) an asphalt cement pump for pumping asphalt cement from the asphalt cement supply tank into and through the asphalt cement flow circuit;

(F) wherein the heating assembly is interposed in the asphalt cement flow circuit between the asphalt cement supply tank and the mechanism for dispensing asphalt cement onto paving material that has been removed from the roadway, said heating assembly further comprising:

(i) a heater comprising:

(a) an asphalt cement coil that is in the asphalt cement flow circuit;

(b) a coil chamber that is defined in part by an outer wall, which coil chamber includes the asphalt cement coil;

(b) a burner that is adapted to direct hot gases of combustion into the coil chamber and across the asphalt cement coil therein;

(ii) a heat modifying component that is adapted to modify the flow of hot gases of combustion from the burner of the heater across the asphalt cement coil in order to control the amount of heat transfer from the hot gases generated by the burner to the asphalt cement in the asphalt cement coil, said heat modifying component comprising an air flow regulator assembly comprising a linear actuator, an upper exhaust vent with an upper damper mounted therein, and a lower exhaust vent with a lower damper mounted therein, said upper exhaust vent and lower exhaust vent being:

(a) mounted so as to be in fluid communication with the coil chamber;

(b) controlled by the linear actuator so that either the upper damper is open and the lower damper is closed, allowing the hot gases of combustion to flow downwardly through and upwardly along the sides of asphalt cement coil before exiting the coil chamber, or the lower damper is open and the upper damper is closed, allowing the hot gases of combustion to flow downwardly through the asphalt cement coil and then out of the coil chamber.

10. The CIR train of claim 9 wherein the air flow regulator assembly includes a linear position sensor that is associated with the linear actuator and is adapted to determine the amount of extension of linear actuator, and hence whether the upper damper and the lower damper are open or closed.

11. The CIR train of claim 10:

(A) which includes a controller;

(B) which includes a temperature sensor that is located in the input line for asphalt cement into the heating assembly;

(C) which includes a temperature sensor that is located in the output line for asphalt cement from the heating assembly;

(D) wherein the controller is operatively attached to the temperature sensor that is located in the input line, the temperature sensor that is located in the output line, the linear actuator, the linear position sensor, the asphalt cement pump and the heater;

(E) wherein the controller is adapted to receive temperature information from the temperature sensors located in the input line into the heating assembly and in the output line from the heating assembly and use such information to control the flow of asphalt cement from the pump and the operation of the heater and the linear actuator of the air flow regulator assembly in order to obtain a desired temperature of asphalt cement passing through the output line for asphalt cement from the heating assembly.

* * * * *